US011753782B2

(12) United States Patent
Ibarra et al.

(10) Patent No.: US 11,753,782 B2
(45) Date of Patent: Sep. 12, 2023

(54) QUICK-REPLACEMENT GEAR FOR GRADE CROSSING GATE MECHANISM

(71) Applicant: C.D.L. Electric Company, Inc., Pittsburg, KS (US)

(72) Inventors: Marco Antonio Ibarra, Pittsburg, KS (US); Devin Steven Sage, Pittsburg, KS (US); Michael Carmen Lawson, Pittsburg, KS (US)

(73) Assignee: C.D.L. Electric Company, Inc., Pittsburg, KS (US)

( * ) Notice: Subject to any disclaimer, the term of this patent is extended or adjusted under 35 U.S.C. 154(b) by 38 days.

(21) Appl. No.: 17/498,495

(22) Filed: Oct. 11, 2021

(65) Prior Publication Data

US 2023/0109820 A1 Apr. 13, 2023

(51) Int. Cl.
*B61L 5/06* (2006.01)
*E01F 13/06* (2006.01)

(52) U.S. Cl.
CPC ..... *E01F 13/06* (2013.01)

(58) Field of Classification Search
CPC ..... E01F 13/06
USPC ..... 49/49
See application file for complete search history.

(56) References Cited

U.S. PATENT DOCUMENTS 2,295,419 A * 9/1942 Miskelly ..... B61L 29/226 74/411
2,488,313 A * 11/1949 Miskelly ..... B61L 29/243 192/105 CD
3,038,991 A * 6/1962 Swanton ..... B61L 29/226 246/219
3,872,738 A 3/1975 Price et al.
3,964,704 A * 6/1976 Karr ..... B61L 29/02 246/272

(Continued)

FOREIGN PATENT DOCUMENTS

DE 1755548 5/1968
EP 2986483 3/2017

(Continued)

OTHER PUBLICATIONS

PCT International Search Report and Written Opinion from PCT Application No. PCT/US2019/033347 entitled Grade Crossing Gate Mechanism (dated Oct. 11, 2019).

(Continued)

*Primary Examiner* — Jerry E Redman
(74) *Attorney, Agent, or Firm* — Hovey Williams LLP

(57) ABSTRACT

A crossing gate mechanism includes a gate mechanism enclosure, a gate arm shaft, and a quick-replacement moon gear assembly. The gate mechanism enclosure defines an interior space. The gate arm shaft extends into the gate mechanism enclosure and is rotatable relative thereto. The quick-replacement moon gear assembly is coupled to the gate arm shaft for rotation therewith and is positioned within the interior space. The quick-replacement moon gear assembly includes a gear hub fixed to the gate arm shaft for rotational movement therewith, and a quick-replacement moon gear releasably coupled to the gear hub. The quick-replacement moon gear is removeable from the interior space while the gear hub remains fixed to the gate arm shaft.

20 Claims, 15 Drawing Sheets

(56) References Cited

U.S. PATENT DOCUMENTS

| | | | | | |
|---|---|---|---|---|---|
| 4,057,208 | A * | 11/1977 | Andrews | B61L 29/04 | 49/138 |
| 4,090,685 | A * | 5/1978 | Pappas | B61L 29/08 | 49/140 |
| 5,543,596 | A * | 8/1996 | Jones | H01H 19/62 | 200/558 |
| 5,852,350 | A * | 12/1998 | LeVoir | B61L 29/22 | 318/281 |
| 6,158,696 | A | 12/2000 | Brodskiy | | |
| 6,218,797 | B1 * | 4/2001 | Williamson | E01F 13/06 | 49/28 |
| 7,195,211 | B2 * | 3/2007 | Kande | B61L 29/16 | 246/473.1 |
| 7,699,271 | B2 * | 4/2010 | Ward | B61L 29/02 | 246/111 |
| 8,054,197 | B1 | 11/2011 | Martin et al. | | |
| 8,418,969 | B2 * | 4/2013 | Schena | F16H 55/12 | 246/219 |
| 9,272,721 | B2 * | 3/2016 | Bohme | B61L 29/10 | |
| 11,273,854 | B2 * | 3/2022 | Ibarra | B61L 29/30 | |
| 2003/0106757 | A1 | 6/2003 | Johnson et al. | | |
| 2007/0130834 | A1 | 6/2007 | Kande et al. | | |
| 2009/0209375 | A1 | 8/2009 | Takamoto | | |
| 2019/0351920 | A1 | 11/2019 | Ibarra et al. | | |
| 2019/0351926 | A1 * | 11/2019 | Ibarra | B61L 29/288 | |
| 2020/0391776 | A1 * | 12/2020 | Spencer | G01L 3/00 | |
| 2021/0001908 | A1 * | 1/2021 | Bohme | B61L 29/04 | |

FOREIGN PATENT DOCUMENTS

| | | | |
|---|---|---|---|
| JP | 2001204251 | A * | 7/2001 |
| JP | 5812762 | | 11/2015 |
| KR | 20120008483 | | 12/2012 |

OTHER PUBLICATIONS

European Search Report from European Patent Application No. 22197457.9 entitled Quick-Replacement Gear for Grade Crossing Gate Mechanism (dated Mar. 9, 2023).

* cited by examiner

QUICK-REPLACEMENT GEAR FOR GRADE CROSSING GATE MECHANISM

FIELD OF THE DISCLOSURE

The field of the disclosure relates generally to grade crossing gate mechanisms and, more particularly, to a quick-replacement gear for grade crossing gate mechanisms.

BACKGROUND

At least some known automatic grade crossing gate systems use a driven moon gear to raise and lower a gate arm. Traditionally, the driven moon gear is keyed and directly coupled to a gate arm shaft. The driven moon gear often requires maintenance and/or replacement, for example, due to wear, rust, broken gear teeth, etc. However, to remove the driven moon gear, a user is typically required to remove the gate arms, the cam lobe assembly, the control board, the gate arm shaft, etc., to unkey the moon gear. Often, replacement of the driven moon gear would take two (2) users a full day of work. Thus, replacement of a failed moon gear is expensive and inefficient. In addition, the automatic grade crossing gate system is rendered inoperable during gear replacement, thereby increasing danger to crossing traffic.

BRIEF DESCRIPTION

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

In one aspect, a crossing gate mechanism is provided. The crossing gate mechanism includes a gate mechanism enclosure defining an interior space. The crossing gate mechanism includes an axially extending gate arm shaft extending into the gate mechanism enclosure and being rotatable relative thereto. Furthermore, the crossing gate mechanism includes a quick-replacement moon gear assembly coupled to the gate arm shaft for rotation therewith and being positioned within the interior space. The quick-replacement moon gear assembly includes a gear hub fixed to the gate arm shaft for rotational movement therewith. In addition, the quick-replacement moon gear assembly includes a quick-replacement moon gear releasably coupled to the gear hub. The quick-replacement moon gear is removeable from the interior space while the gear hub remains fixed to the gate arm shaft.

Advantages of these and other embodiments will become more apparent to those skilled in the art from the following description of the exemplary embodiments which have been shown and described by way of illustration. As will be realized, the present embodiments described herein may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of systems and methods disclosed therein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

Figure 1:
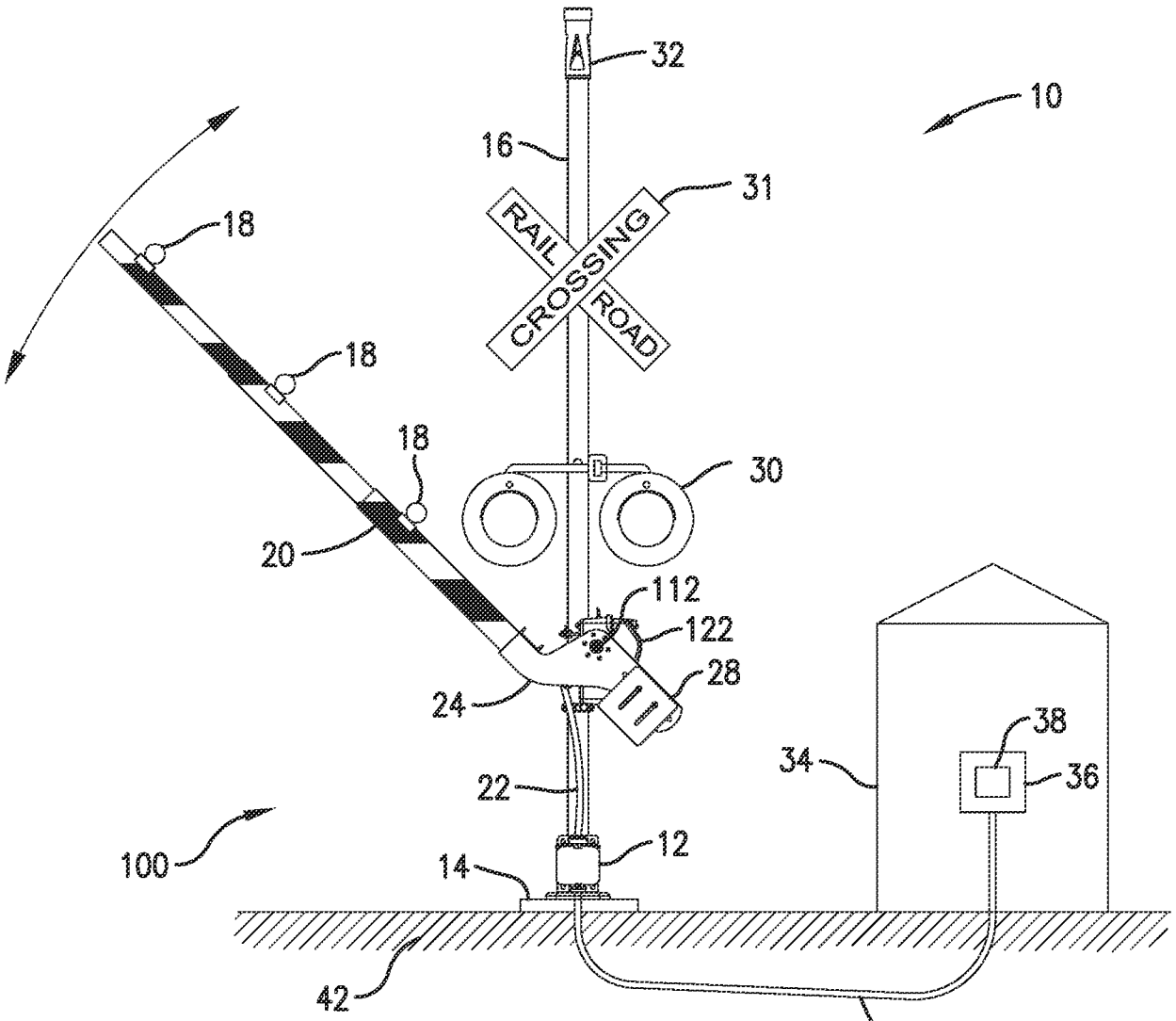
FIG. 1 is an elevation view of a grade crossing gate system in accordance with one aspect of the present invention.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein. While the drawings do not necessarily provide exact dimensions or tolerances for the illustrated components or structures, the drawings are to scale with respect to the relationships between the components of the structures illustrated in the drawings.

DETAILED DESCRIPTION

The following detailed description of embodiments of the disclosure references the accompanying figures. The embodiments are intended to describe aspects of the disclosure in sufficient detail to enable those with ordinary skill in the art to practice the disclosure. The embodiments of the disclosure are illustrated by way of example and not by way of limitation. Other embodiments may be utilized, and changes may be made without departing from the scope of the claims. The following description is, therefore, not limiting. The scope of the present disclosure is defined only by the appended claims, along with the full scope of equivalents to which such claims are entitled.

In this description, references to "one embodiment," "an embodiment," or "embodiments" mean that the feature or features referred to are included in at least one embodiment of the disclosure. Separate references to "one embodiment," "an embodiment," or "embodiments" in this description do not necessarily refer to the same embodiment and are not mutually exclusive unless so stated. Specifically, a feature, component, action, step, etc. described in one embodiment may also be included in other embodiments but is not necessarily included. Thus, particular implementations of the present disclosure can include a variety of combinations and/or integrations of the embodiments described herein.

In the following specification and the claims, reference will be made to several terms, which shall be defined to have the following meanings. The singular forms "a," "an," and "the" include plural references unless the context clearly dictates otherwise. "Optional" or "optionally" means that the subsequently described feature, event, or circumstance may or may not be required or occur, and that the description includes instances with or without such element.

Approximating language, as used herein throughout the specification and the claims, may be applied to modify any quantitative representation that could permissibly vary without resulting in a change in the basic function to which it is related. Accordingly, a value modified by a term or terms, such as "about," "approximately," and "substantially" are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, directional references, such as, "top," "bottom," "front," "back," "side," and similar terms are used herein solely for convenience and should be understood only in relation to each other. For example, a component might in practice be oriented such that faces referred to herein as "top" and "bottom" are in practice sideways, angled, inverted, etc. relative to the chosen frame of reference.

FIG. 1 is an elevation view of a grade crossing gate system 10, constructed in accordance with a preferred embodiment of the present invention. The crossing gate system 10 includes a crossing gate mechanism 100 having a base 12 secured to the ground 42 by a concrete foundation 14. The base 12 supports a mast 16. A gate mechanism enclosure 122 is coupled to the mast 16 and houses electrical and mechanical components (not shown in FIG. 1) for raising and lowering a gate arm 20. Power and control wires 22 (also referred to herein as external wires) run between the base 12 and the gate mechanism enclosure 122. The gate arm 20 is coupled to one or more rotatable counterweight arms 24 swingably supported on the mast 16. The counterweight arm 24 is coupled to a gate arm shaft 112 that extends through the gate mechanism enclosure 122 and is coupled to a gear train 110 (not shown in FIG. 1) enclosed therein. A plurality of counterweights 28 are coupled to the counterweight arm 24 opposite the gate arm 20. The counterweights 28 are adjustable relative to the counterweight arm 24 to facilitate counterbalancing the gate arm 20, thereby reducing the power required to raise the gate arm 20 from a substantially horizontal position to a generally vertical position. In addition, a plurality of signal lights 30, a warning sign 31, and a warning bell 32 are coupled to the mast 16 above the gate mechanism enclosure 122. Furthermore, a plurality of warning lights 18 are coupled to the gate arm 20.

The crossing gate system 10 includes a control shelter 34 located remote relative to the crossing gate mechanism 100. The control shelter 34 houses a crossing control logic unit 36 that is programmed with crossing control logic 38. The crossing control logic unit 36 is electrically coupled to the power and control wires 22 of the crossing gate mechanism 100 via a signal cable 40. The crossing control logic 38 generates commands that are transmitted by the crossing control logic unit 36 as command signals to the electrical and mechanical components of the crossing gate mechanism 100. The command signals command the electrical and mechanical components of the crossing gate mechanism 100 to move the gate arm 20 between the vertical or horizontal positions to clear or block traffic. In addition, the crossing control logic 38 receives status information from the gate mechanism 100.

Figure 2:
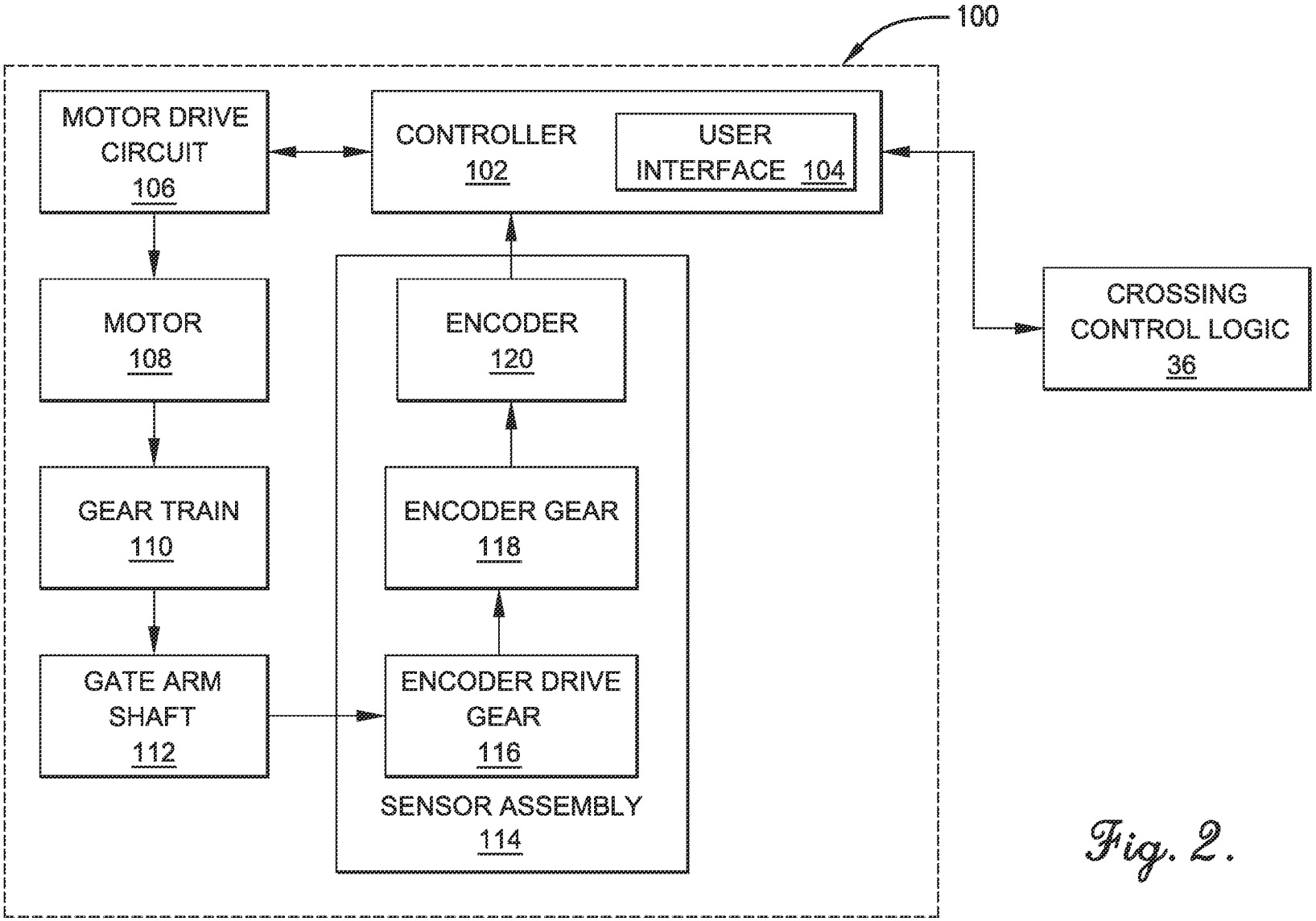
FIG. 2 is a block diagram for the grade crossing gate mechanism as shown in FIG. 1.

FIG. 2 is a block diagram for the grade crossing gate mechanism 100, in accordance with one aspect of the present invention. In the exemplary embodiment, the grade crossing gate mechanism 100 includes a controller 102 that has a user interface 104. The user interface 104 may include, for example, and without limitation, a graphical user interface (GUI) and/or a command line interface. The controller 102 receives inputs (e.g., command signals) from the crossing control logic 38 and transmits status information to the crossing control logic 38. The controller 102 is coupled to a motor drive circuit 106 configured to channel electrical power to a motor 108. The motor drive circuit 106 is also used to switch the polarity of the electrical power, thereby changing a rotational direction of the motor 108, upon instruction by the controller 102.

The motor 108 is coupled to the gear train 110. The gear train 110 includes the gate arm shaft 112 coupled to a gate arm, such as the gate arm 20, to raise or lower the gate arm. The motor 108 generates torque to rotate the gate arm shaft 112 when electrical power is supplied to the motor 108. The gear train 110 operates to multiply the torque of the motor 108, thereby reducing the power requirements and physical size of the motor 108.

The grade crossing gate mechanism 100 also includes an electronic sensor assembly 114 (broadly, a gate arm position sensing assembly). The sensor assembly 114 includes a driving element 116 and an electronic transducer 120 having a driven element 118 coupled thereto. In the exemplary embodiment, the electronic transducer 120 is an encoder, the driving element 116 is an encoder drive gear, and the driven element 118 is an encoder gear. While the electronic sensor assembly 114 is shown as employing an intermeshed gear drive assembly for driving the encoder 120, other aspects of the present invention contemplate alternative positive drive systems including, without limitation, chain drives, toothed belt drives, positive clutch drives, or other positive drive systems that enable the electronic sensor assembly 114 to function as described herein.

In the exemplary embodiment, the encoder drive gear 116 is mechanically coupled to the gate arm shaft 112, as will be described further herein. The encoder drive gear 116 is drivingly coupled to the encoder gear 118. The encoder gear 118 rotates the encoder 120 upon rotation of the gate arm shaft 112. The angular position of the gate arm shaft 112 is sensed (e.g., detected) by the encoder 120 and a position signal corresponding thereto is transmitted to the controller 102 by the encoder 120. The controller 102 transmits the corresponding position signal as status information to the crossing control logic 38 of the crossing control logic unit 36. It is contemplated that, with respect to other aspects of the present invention, the gate arm position sensing assembly may include any mechanism operatively coupled to the gate arm shaft and capable of sensing the gate arm position, such as a traditional mechanical cam/lobe assembly.

Figure 3:
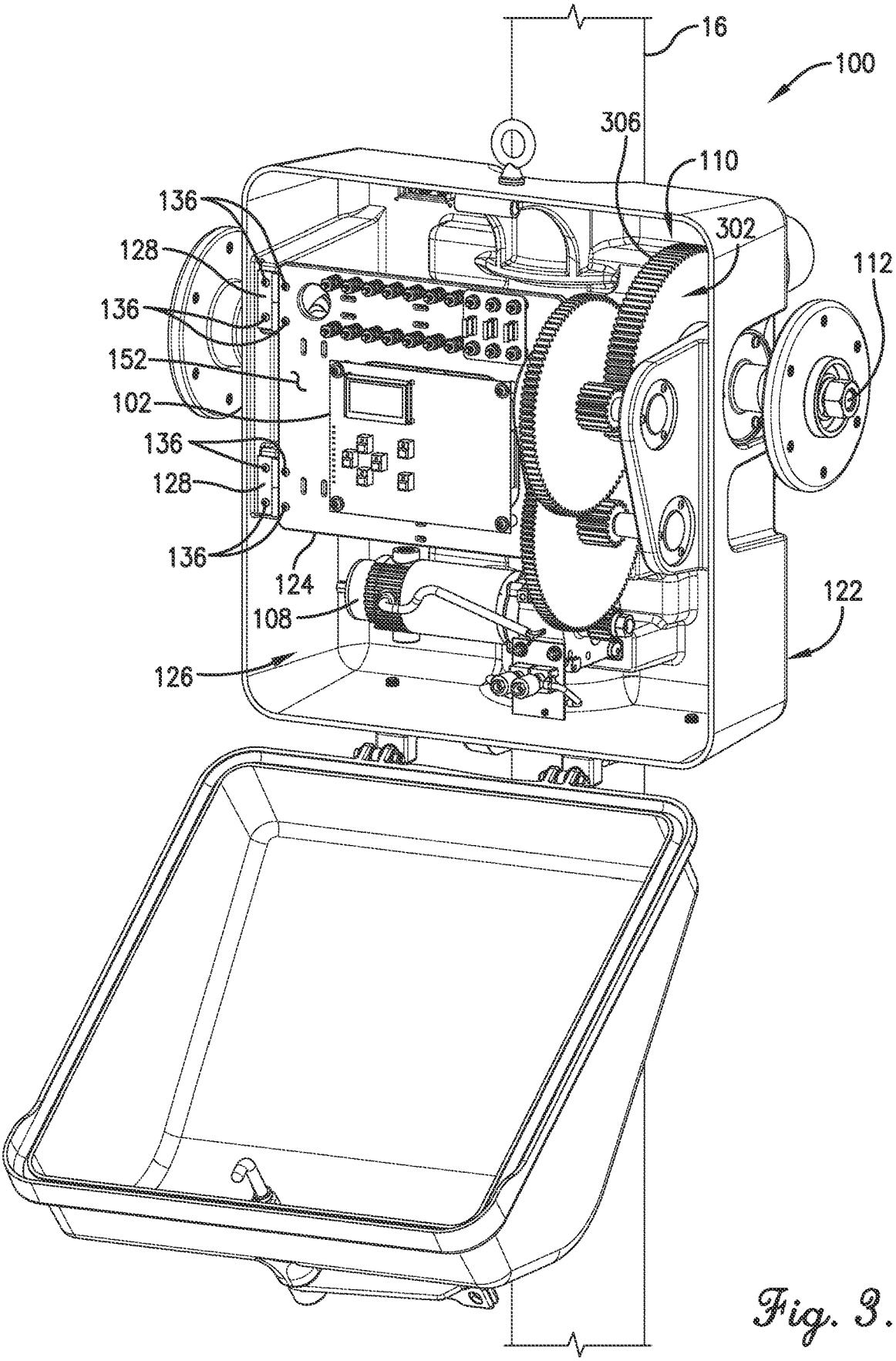
FIG. 3 is a front, right partial perspective of the grade crossing gate mechanism of FIG. 1, showing a gate mechanism enclosure in an opened configuration.
Figure 4:
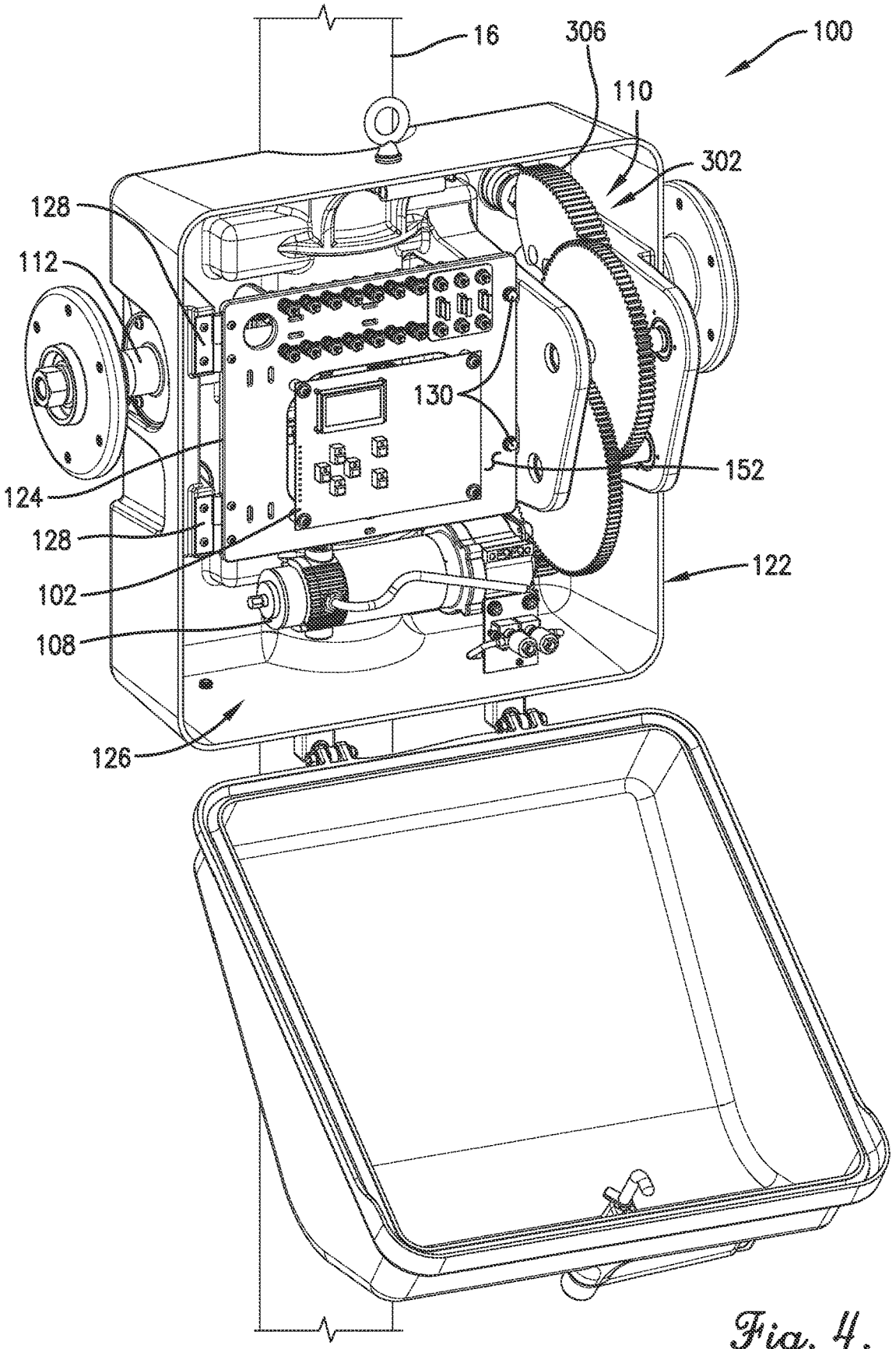
FIG. 4 is a front, left partial perspective of the grade crossing gate mechanism of FIG. 1, showing a terminal board in the operative configuration.
Figure 5:
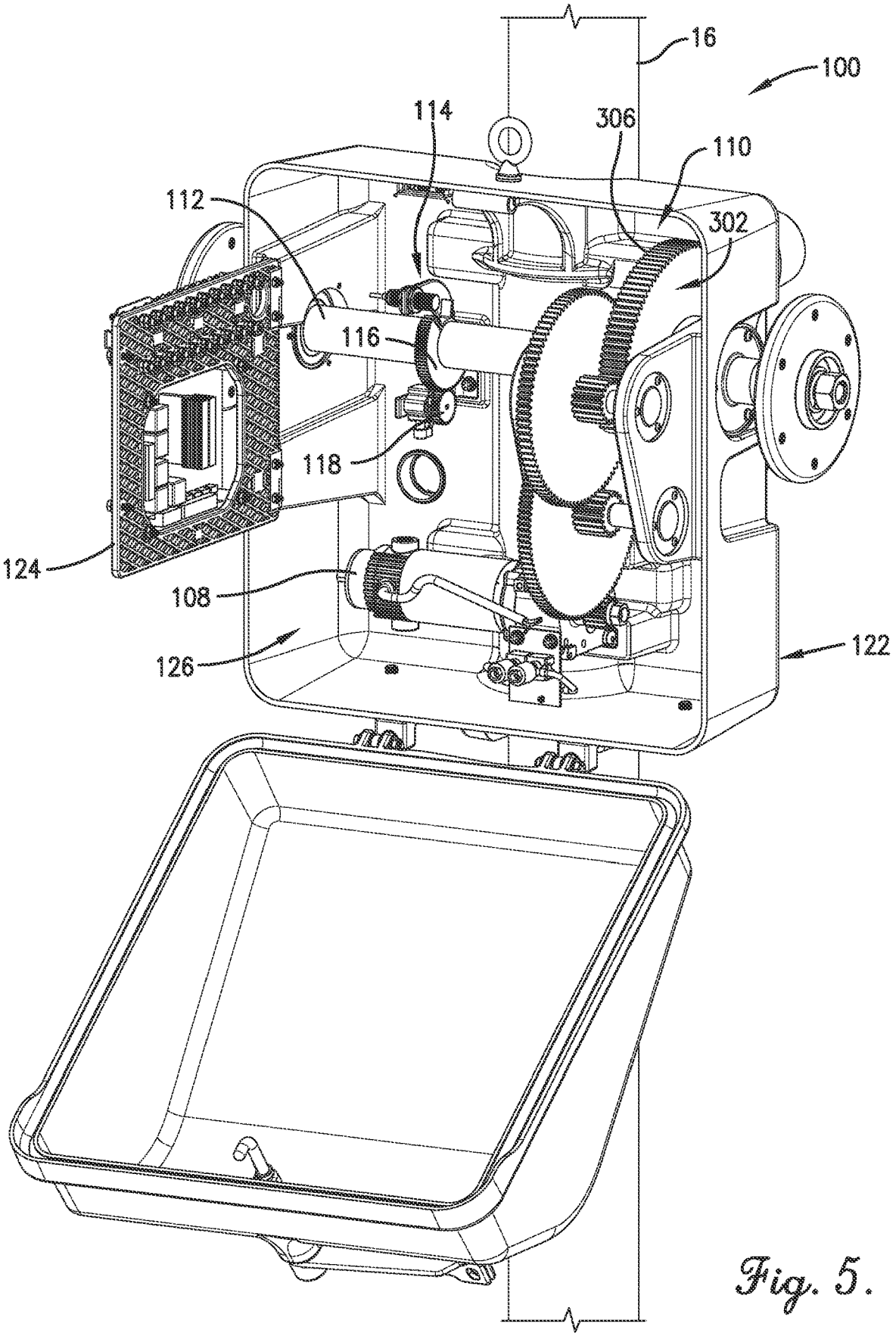
FIG. 5 is a front, right partial perspective of the grade crossing gate mechanism of FIG. 1, showing the terminal board in an access configuration.

FIG. 3 is a front, right partial perspective of the grade crossing gate mechanism 100, showing the gate mechanism enclosure 122 in an opened configuration and a terminal board 124 in an operative configuration (also referred to as a secured configuration). FIG. 4 is a front, left partial perspective of the grade crossing gate mechanism 100, showing the terminal board 124 in the operative configuration. FIG. 5 is a front, right partial perspective of the grade crossing gate mechanism 100, showing the terminal board 124 in an access configuration (also referred to as an unsecured configuration). Referring to FIGS. 3-5, in the exemplary embodiment, the gate mechanism enclosure 122 is coupled to a mast, such as the mast 16, described herein. The gate mechanism enclosure 122 defines an interior space 126. The motor 108 is positioned within the interior space 126 and is coupled to the gate mechanism enclosure 122. The gear train 110 is at least partially positioned within the interior space 126. An output shaft of the gear train 110, referred to as the gate arm shaft 112, extends through the gate mechanism enclosure 122, and therefore the interior space 126. The gear train 110 and the motor 108 are rotatably coupled together.

In the exemplary embodiment, the terminal board 124 and the controller 102 are positioned above the motor 108 within the gate mechanism enclosure 122, as illustrated in FIGS. 3 and 4. However, aspects of the present invention contemplate positioning the terminal board 124 and the controller 102 within the gate mechanism enclosure 122 in any location relative to the motor 108 that enables the grade crossing gate mechanism 100 to function as described herein. As shown in FIGS. 3 and 4, the terminal board 124 is swingably or rotatably coupled to the gate mechanism enclosure 122 by one or more hinges 128 (also referred to as mounting components). In the exemplary embodiment, the hinges 128 are lift off hinges. However, in other aspects of the present invention, the hinges 128 may include, for example, and without limitation, a fixed-pin hinge, a barrel hinge, a pivot hinge, a butt hinge, a continuous hinge, a living hinge, and the like.

It is noted that the hinges 128 enable the terminal board 124 to be swung or rotated relative to the gate mechanism enclosure 122 between the operative configuration (see FIGS. 3 and 4) and the access configuration (see FIG. 5). In a preferred embodiment, the sensor assembly 114 is positioned behind the terminal board 124, such that the terminal board 124 overlies the sensor assembly 114 when the terminal board is in the operative configuration. In the access configuration, the terminal board 124 may be freely rotated about a rotation axis of the hinges 128 to facilitate access, for example, to the sensor assembly 114.

Referring to FIG. 3, the terminal board 124 is further coupled to the gate mechanism enclosure 122 by one or more closure components 130 when in the operative configuration. The closure components 130 engage a front surface 152 of the terminal board 124, opposite the hinges 128, and are coupled to the gate mechanism enclosure 122 to prevent rotation of the terminal board 124 about the hinge axis. In the exemplary embodiment, the closure components 130 are threaded fasteners. However, in other aspects of the present invention, the closure components 130 may include any fastening device that enables the grade crossing gate mechanism 100 to function as described herein, including, for example, pins, rivets, latches, and the like.

Figure 6:
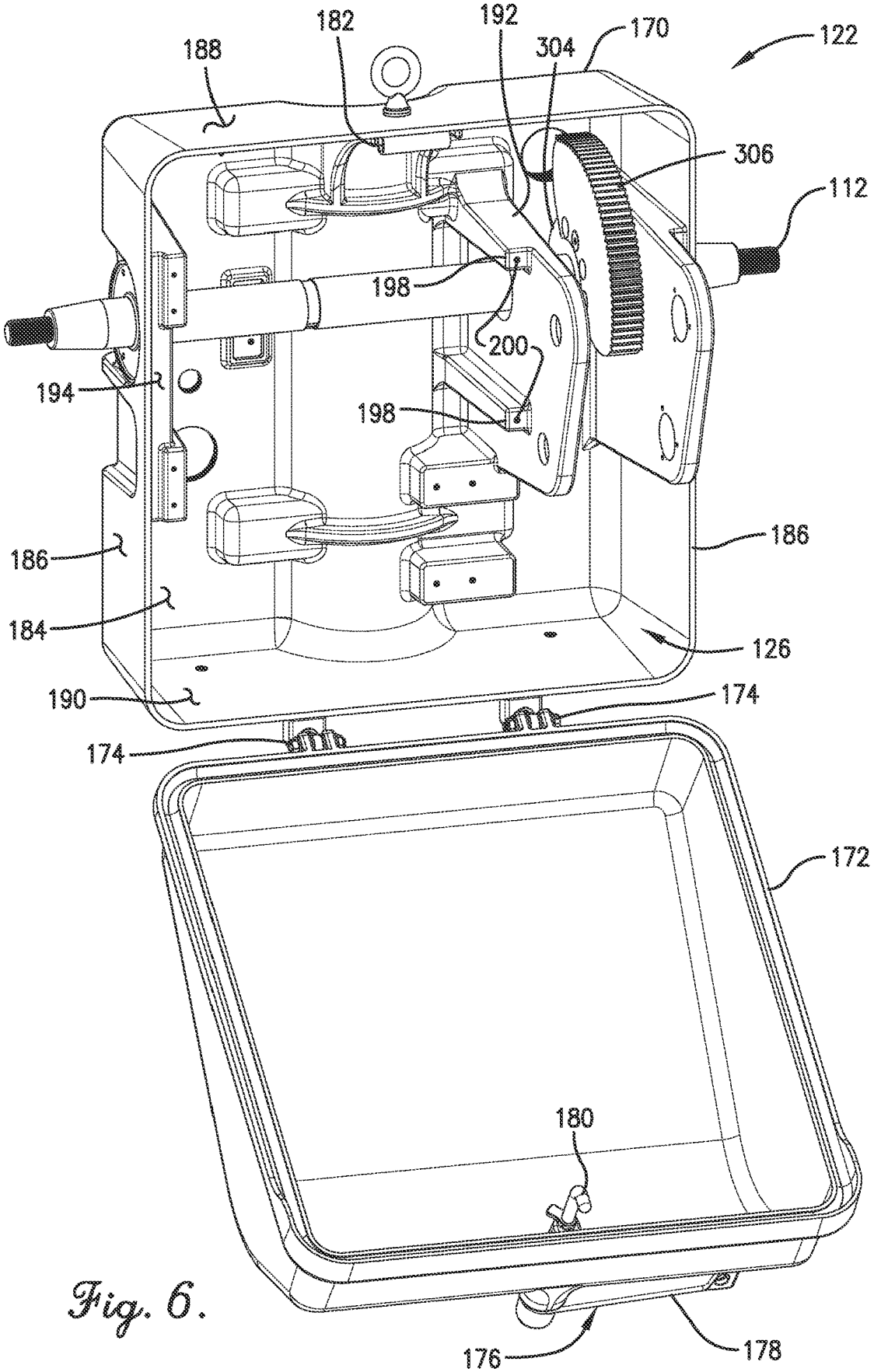
FIG. 6 is a perspective view of the gate mechanism enclosure as depicted in FIGS. 3-5, shown in an open configuration, with various elements removed to depict the construction of the enclosure itself and the location of the gate arm shaft within the enclosure.

FIG. 6 is a perspective view of the gate mechanism enclosure 122, depicting the enclosure 122 in an open configuration. In FIG. 6, many of the internal components (described above with respect to FIGS. 3-5) housed in the enclosure 122 are hidden for clarity. The enclosure 122 is depicted with the gate arm shaft 112 and a driven quick-replacement moon gear assembly 302. In the exemplary embodiment, the gate mechanism enclosure 122 generally comprises a base 170 and a lid 172 (together broadly defining a housing). The lid 172 is releasably connectable to the base 170 for positioning relative to the base 170, such that the gate mechanism enclosure 122 is shiftable between an opened configuration and a closed configuration. In a closed configuration (not shown), the lid 172 and base 170 together form a substantially enclosed interior space 126.

In the illustrated opened configuration, the lid 172 is generally positioned, at least in part, away from the base 170 to provide access to the interior space 126 for servicing or maintenance of the crossing gate mechanism 100 such as, without limitation, inspecting the components contained therein (e.g., the motor 108, the gear train 110, the quick-replacement moon gear assembly 302, etc.), servicing (or replacing) the quick-replacement moon gear assembly 302, adjusting the sensor assembly 114, and accessing the controller 102. The base 170 and lid 172 may be suitably fabricated from any number of materials, including for example, and without limitation, metal, plastic, fiber-reinforced polymers, or other suitable weather resistant material. For example, the base 170 and lid 172 may be formed in a molding process used for producing parts from thermoplastic or thermosetting plastic materials. However, in alternative aspects of the present invention, the base 170 and lid 172 may be constructed from other suitable materials. The base 170 and the lid 172 may also be alternatively constructed of different materials from each other, without departing from the scope of the invention.

The lid 172 is suitably hinged to the base 170, such as by a plurality of hinges 174, including for example, mechanical hinges or other suitable hinge configurations for enabling hinged movement of the lid 172 (and therefore correspondingly shifting of the gate mechanism enclosure 122 between the opened and closed configurations), while maintaining connection of the lid 172 to the base 170 to inhibit loss of the lid during servicing of the crossing gate mechanism 100. It is understood that in alternative aspects of the present invention, the lid 172 may be attached to the base 170 other than by a hinge and remain within the scope of this invention. Furthermore, alternative aspects of the present invention contemplate that the lid 172 may be entirely separable from the base 170 without departing from the scope of this invention.

In the closed configuration of the gate mechanism enclosure 122, the lid 172 and base 170 are releasably held together (i.e., secured or interlocked) by a suitable locking mechanism 176 to inhibit unauthorized or unintended opening of the gate mechanism enclosure 122. Additionally, more than one locking mechanism may be employed to releasably hold together the lid 172 and base 170 in the closed configuration of the gate crossing mechanism 100. The locking mechanism 176 includes a rotatable handle 178 that is exterior to the interior space 126. A latching member 180, which is on the interior side of the lid 172, is coupled to the handle 178 and is configured to engage or catch a lock member 182 coupled to the base 170. In alternative embodiments of the present invention, the handle 178 and latching member 180 may be coupled to the base 170, and the lock member 182 may be coupled to the lid 172 in a manner that enables the locking mechanism 176 to function as described herein. To unlock the locking mechanism 176, the handle 178 is rotated about ninety degrees (90°) in an upward direction. The latching member 180 subsequently rotates about ninety degrees (90°) and disengages the lock member 182. The lid 172 may then be rotated to the opened configuration (FIG. 6) for access to the interior space 126.

The illustrated base 170 comprises a back panel 184, laterally opposite sidewalls 186 that broadly define opposite sides of the gate mechanism enclosure 122, a top wall 188, and a bottom wall 190. In the illustrated embodiment the back panel 184, sidewalls 186, top wall 188, and bottom wall 190 of the base 170 together define an open, generally rectangular shape. It is understood, however, that the base 170 may be shaped other than as illustrated without departing from the scope of this invention, and that in alternative aspects of the present invention, the lid 172 may instead, or additionally define one or more of the sides of the housing and/or the top or bottom walls of the housing. The back panel 184, sidewalls 186, top wall 188, and bottom wall 190 of the base are formed integrally in the illustrated embodiment, such as by being molded as a single piece. However, in other aspects of the present invention, one or more of these walls may be formed separate from the others and connected thereto such as by welding, fastening, adhering, or other suitable connection technique.

In the exemplary embodiment, the base 170 also has at least one interior, upstanding wall 192 (otherwise referred to herein as an upstanding sidewall or interior wall) extending outward relative to the back panel 184. Such an arrangement enables the gear train 110, and in particular, the quick-replacement moon gear assembly 302, to be easily serviced when the lid 172 is opened for servicing, e.g., without having to remove and/or open a separate gear train housing.

The upstanding wall 192 comprises a pair of outer edge portions 198 defining support surfaces and having a plurality of securing structures 200 thereon. The outer edge portions 198 are generally parallel to the back panel 184. The back panel 184 and upstanding wall 192 are preferably formed integrally, such as by molding them as a single piece, although these components may be formed separate and connected by any suitable connection technique. As described above with reference to FIG. 3, the terminal board 124 is coupled to the gate mechanism enclosure 122 by one or more closure components 130 when in the operative configuration. In particular, the back surface 154 of the terminal board 124 is in face-to-face contact with the outer edge portions 198. The closure components 130 engage the front surface 152 of the terminal board 124, extend through a closure hole 234 of the terminal board 124, and are threadedly coupled to the securing structures 200.

As depicted in FIG. 6, the gate arm shaft 112 extends into the gate mechanism enclosure 122, and in particular, through each of sidewalls 186 and the upstanding wall 192. The quick-replacement moon gear assembly 302 is coupled to the gate arm shaft 112 for rotation therewith and is positioned between the upstanding wall 192 and a sidewall 186 of the enclosure 122. The quick-replacement moon gear assembly 302 includes a gear hub 304 coupled to the gate arm shaft 112 and a quick-replacement moon gear 306 releasably coupled to the gear hub 304. The arrangement of the moon gear 306 being releasably coupled to the gear hub 304 facilitates servicing and/or replacing the moon gear 306 without the need to remove (or otherwise adjust the position of) the gate arm shaft 112 from the enclosure 122. That is, the moon gear 306 is removeable from the gear hub 304 without requiring axial shifting of the gate arm shaft 112 (i.e., while the gear hub 304 remains fixed to the gate arm shaft 112), which is contrary to traditional automatic grade crossing gate systems, in which the driven moon gear is keyed and coupled directly to the gate arm shaft.

Figure 7:
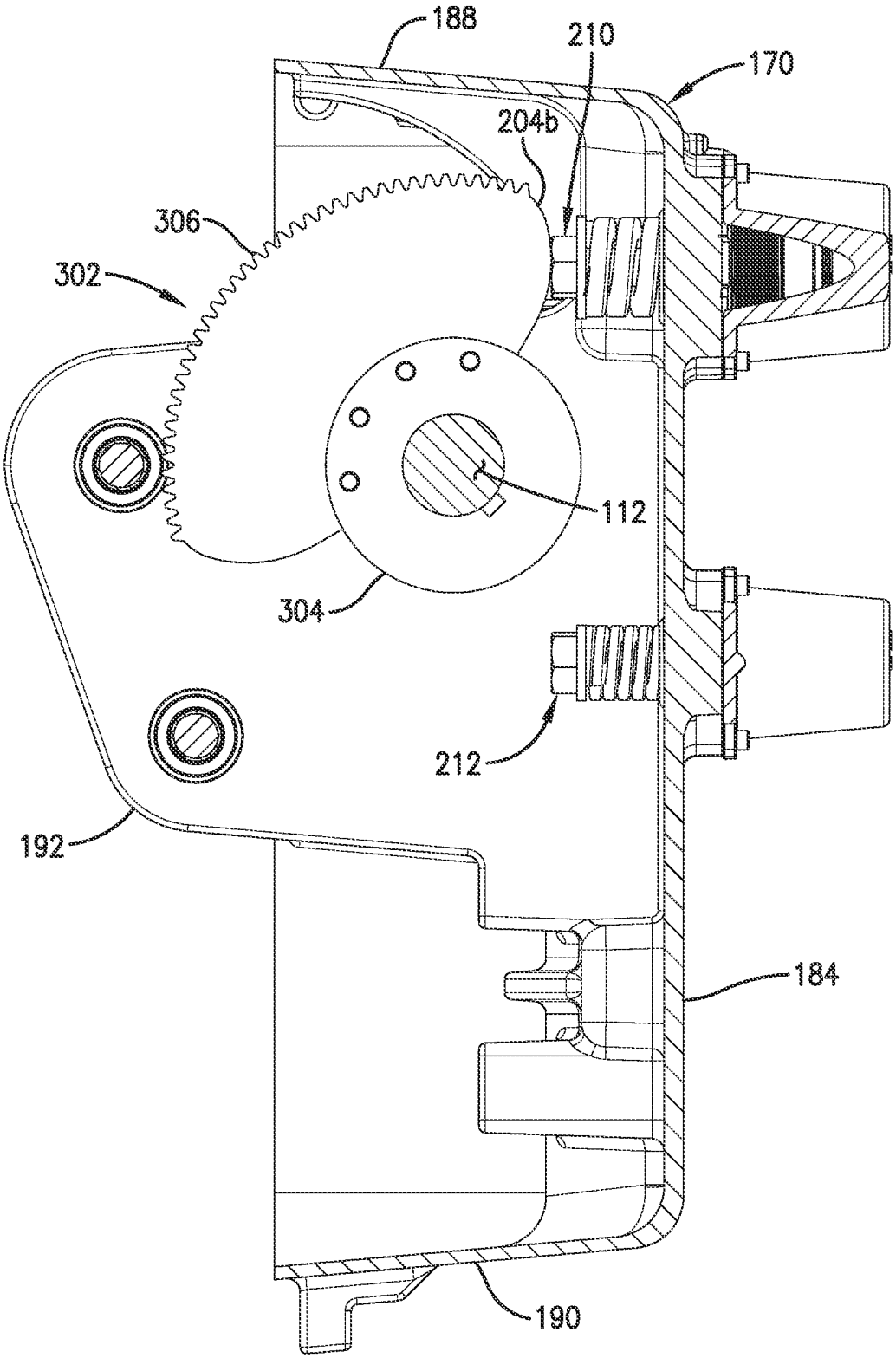
FIG. 7 is a side section of the gate mechanism enclosure shown in FIG. 6, depicting a quick-replacement moon gear assembly in a position when a gate arm (shown in FIG. 1) is in a substantially horizontal position.

FIG. 7 is a side section of the gate mechanism enclosure 122 shown in FIG. 6, depicting the quick-replacement moon gear assembly 302 in a position when the gate arm 20 (shown in FIG. 1) is in a substantially horizontal position. In the illustrated orientation, the moon gear 306 is positioned adjacent, or in face-to-face contact, with a horizontal bump stop assembly 210. The horizontal bump stop assembly 210 is coupled to the back panel 184 of the base 170. The bump stop assembly 210 is constructed to prevent over travel of the gate arm 20 and to provide a cushion (also called a soft stop). The bump stop assembly 210 also keeps the moon gear 306 from contacting the base 170, which may damage one or more of the moon gear 306 and the base 170. In the orientation depicted in FIG. 7, the contact between the moon gear 306 and the bump stop assembly 210 facilitates holding the gate arm 20 in a substantially horizontal position. This facilitates reducing a load on the gear train 110 and the motor 108 when the gate arm 20 is positioned in a horizontal position.

Figure 8:
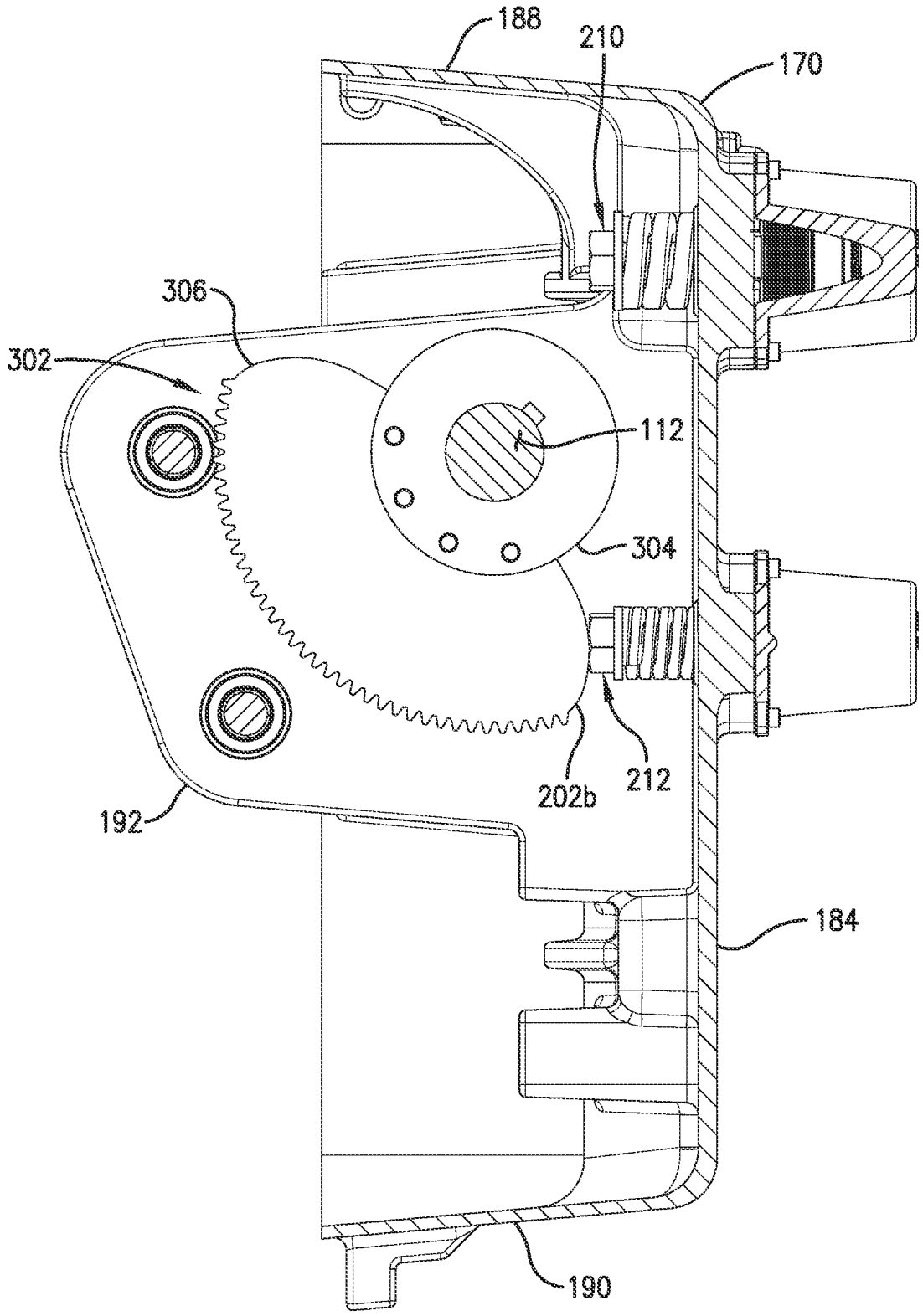
FIG. 8 is a side section of the gate mechanism enclosure shown in FIG. 6, depicting the quick-replacement moon gear assembly in a position when the gate arm is in a substantially vertical position.

FIG. 8 is a side section of the gate mechanism enclosure 122 shown in FIG. 6, depicting the quick-replacement moon gear assembly 302 in a position when the gate arm 20 (shown in FIG. 1) is in a substantially vertical position. In the illustrated orientation, the moon gear 306 is positioned adjacent, or in face-to-face contact, with a vertical bump stop assembly 212. The vertical bump stop assembly 212 is coupled to the back panel 184 of the base 170. The bump stop assembly 212 is constructed to prevent over travel of the gate arm 20 and to provide a cushion. Further, the bump stop assembly 212 keeps the moon gear 306 from contacting the base 170, which may damage one or more of the moon gear 306 and the base 170.

Figure 9:
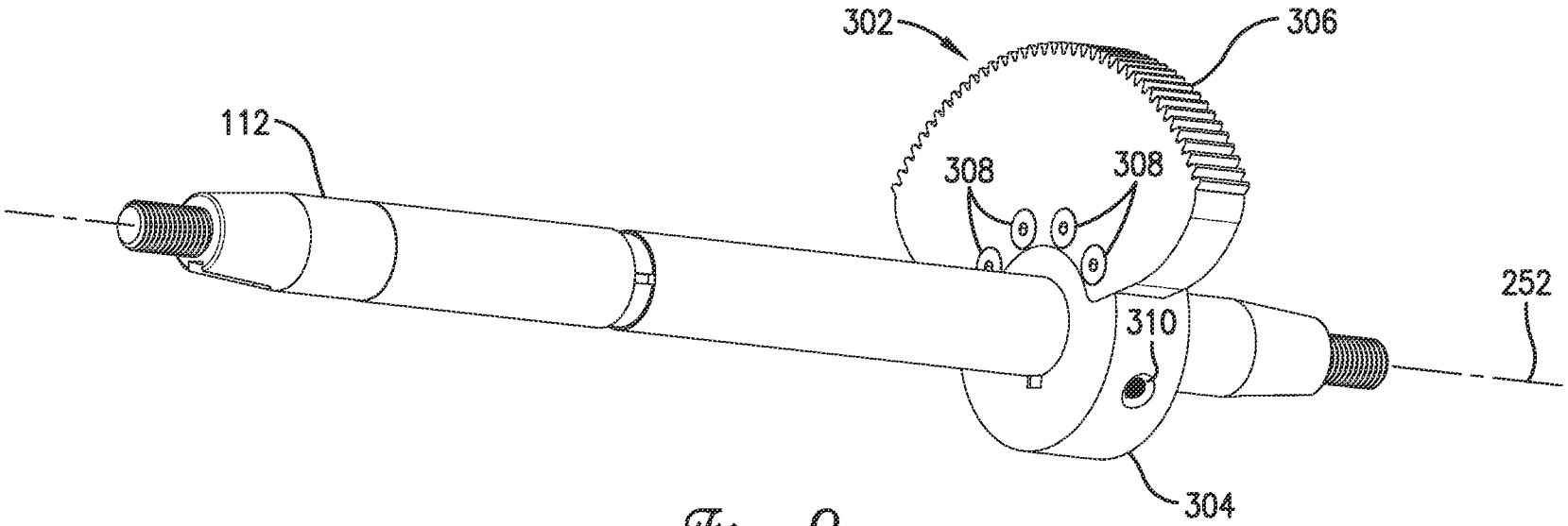
FIG. 9 is a perspective view of the gate arm shaft having the quick-replacement moon gear assembly coupled thereto.
Figure 10:
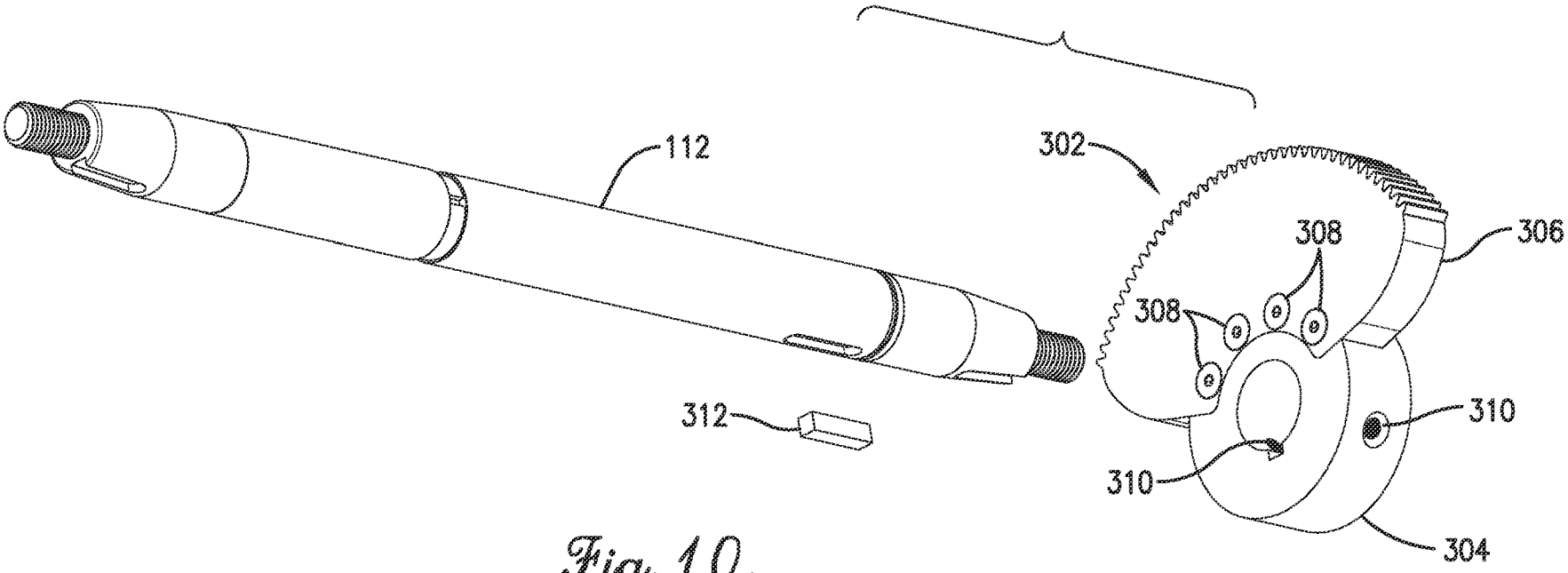
FIG. 10 is an exploded perspective view of FIG. 9.

FIG. 9 is a perspective view of the gate arm shaft 112 having the quick-replacement moon gear assembly 302 coupled thereto. FIG. 10 is an exploded perspective view of FIG. 9. In the example embodiment, a shaft key 312 is used to rotatably secure the gear hub 304 to the gate arm shaft 112. The shaft key 312 facilitates imparting rotation to the gate arm shaft 112 when torque is applied to the moon gear 306, for example, by the motor 108 (shown in FIGS. 3-5).

In the depicted embodiment, the gear hub 304 is fixed to the gate arm shaft 112. In particular, the gear hub 304 includes one or more securing structures 310 for receiving respective fasteners (e.g., fastener components 324 shown in FIG. 11). The fasteners extend into the securing structures 310 and contact the gate arm shaft 112 to facilitate securing the gear hub 304 to a selected axial position along the gate arm shaft 112, as described herein.

The moon gear 306 is coupled to the gear hub 304 via a plurality of fastener components 308, such that a circular pitch of the moon gear 306 is substantially concentric with the gate arm shaft 112, and more particularly, a rotation axis 252 of the gate arm shaft 112. In the exemplary embodiment, the moon gear 306 includes four (4) fastener components 308 securing the moon gear 306 to the gear hub 304. In the example embodiment, the fastener components 308 are most preferably externally threaded screws. It is noted that fewer or more fastener components are contemplated in alternative embodiments of the quick-replacement moon gear assembly 302. As described further herein, the moon gear 306 fits into an axial notch 316 (shown in FIG. 11) defined in an axial face of the gear hub 304 to facilitate transferring torque from the motor 108 to the gear hub 304.

Figure 11:
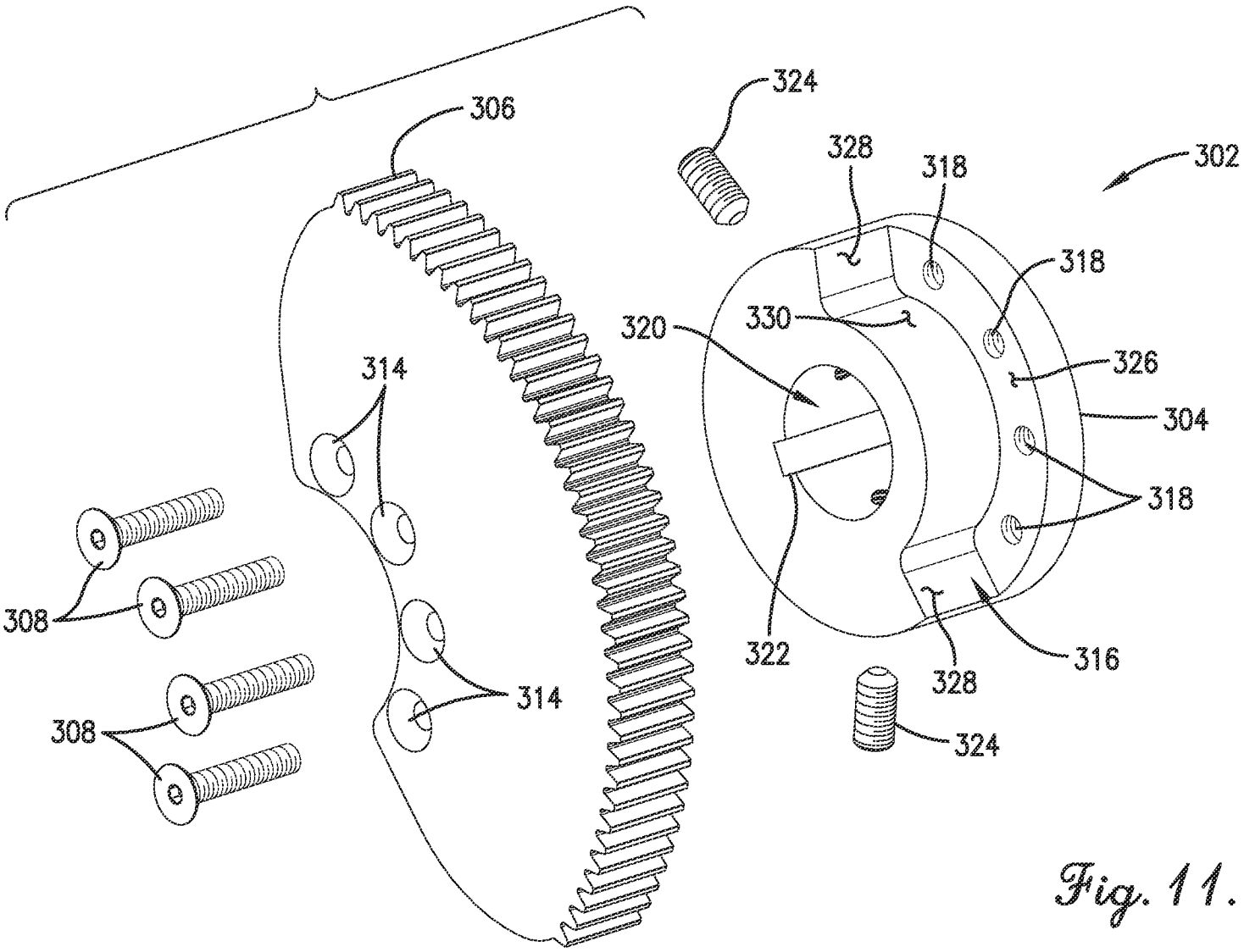
FIG. 11 is an exploded perspective view of the quick-replacement moon gear assembly shown in FIGS. 9 and 10.

FIG. 11 is an exploded perspective view of the quick-replacement moon gear assembly 302. In the example, the gear hub 304 includes the notch 316 defined therein for receiving at least a portion of the moon gear 306. The preferred notch 316 defines an axial edge portion 326, a pair of radial wall portions 328, and an inner circumferential surface 330. As described above, the notch 316 and the moon gear 306 are complementary shaped such that the circular pitch of the moon gear 306 is substantially concentric with a central opening 320 defined in the gear hub 304. This facilitates locating the moon gear such that it is concentric with the rotation axis 252 of the gate arm shaft 112 when the gear hub is coupled to the gate arm shaft. The notch 316 and the moon gear 306 are also designed to facilitate torque transfer (e.g., via the radial wall portions 328 and radial walls 202 and 204 (shown in FIG. 14) of the moon gear 306). It is noted that alternative but contemplated shapes of the notch 316 and the moon gear 306 are within the ambit of certain aspects of the present invention.

To facilitate releasably coupling the gear hub 304 to the gate arm shaft 112, the gear hub 304 includes a keyway 322 extending axially through the central opening 320. The keyway 322 is sized and shaped to receive the shaft key 312 (shown in FIG. 10) therein. Furthermore, a respective fastener component 324 is inserted into the securing structures 310 (shown in FIGS. 9 and 10). In the example embodiment, the fastener components 324 are most preferably externally threaded set screws and the securing structures 310 are most preferably internally threaded radial through-holes. In the exemplary embodiment, the fastener components 324 are threadably tightened against the gate arm shaft 112 to secure the gear hub 304 to a selected axial position along the gate arm shaft 112.

The gear hub 304 includes a plurality of securing structures 318 defined in the axial edge portion 326 of the gear hub 304. In the example, the securing structures 318 are most preferably internally threaded through-holes. Each securing structure 318 is configured to receive a fastener component 308 therein. As described above, the fastener components 308 are most preferably externally threaded screws. The moon gear 306 includes a plurality of holes 314 defined therethrough, each axially aligned with a respective securing structure 318. A respective fastener component 308 is inserted through a respective hole 314 and threadably tightened to a securing structure 318 to secure the moon gear 306 to the gear hub 304.

Figure 12:
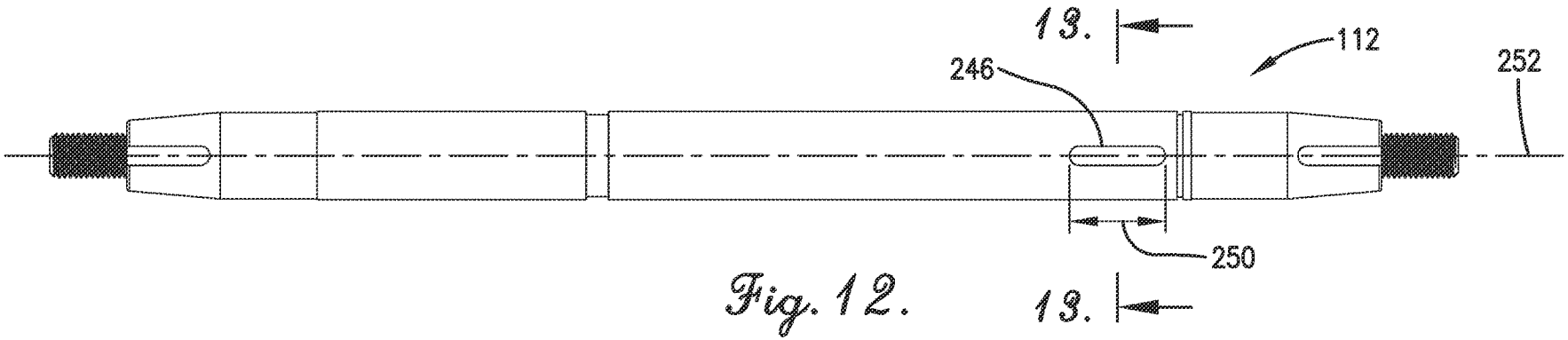
FIG. 12 is a plan view of the gate arm shaft.
Figure 13:
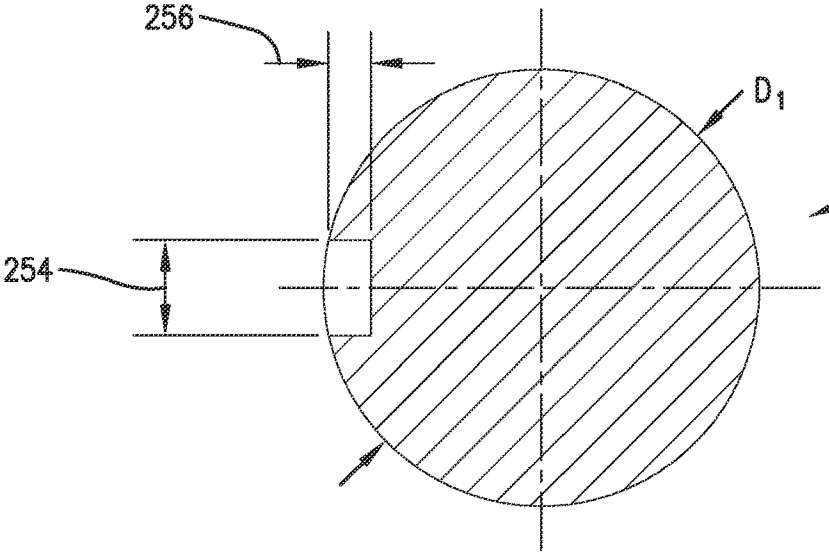
FIG. 13 is a section view of the gate arm shaft taken along line 13-13 of FIG. 12.

As shown in FIGS. 12 and 13, the gate arm shaft 112 is generally cylindrical in shape having a predetermined maximum outer diameter of $D_1$, determined, for example, at least in part on a strength necessary to carry the gate arm 20 (shown in FIG. 1). An axial groove 246 extends axially a predetermined distance 250. As shown in FIGS. 12 and 13, the axial groove 246 extends axially along the rotation axis 252 and is substantially centered thereon. As shown in FIG. 13, the axial groove 246 has a width 254 and a depth 256, which are sized and shaped to receive a portion of the shaft key 312 (shown in FIG. 10). In particular, the width 254 and depth 256 are sized to slidably engage the shaft key 312. A portion of the shaft key 312 is also received in the keyway 322 of the gear hub 304 to rotatably fix the gear hub 304 to the gate arm shaft 112. Alternative means for fixing the gear hub 304 to the gate arm shaft 112 are within the ambit of certain aspects of the present invention. For example, the gear hub 304 may be press fit onto the gate arm shaft 112, the gear hub 304 and the gate arms shaft 112 may be splined or have complemental polygonal cross sectional shapes (at least to some axial extent), etc., without departing from the spirit of certain aspects of the p[resent invention.

Figure 14:
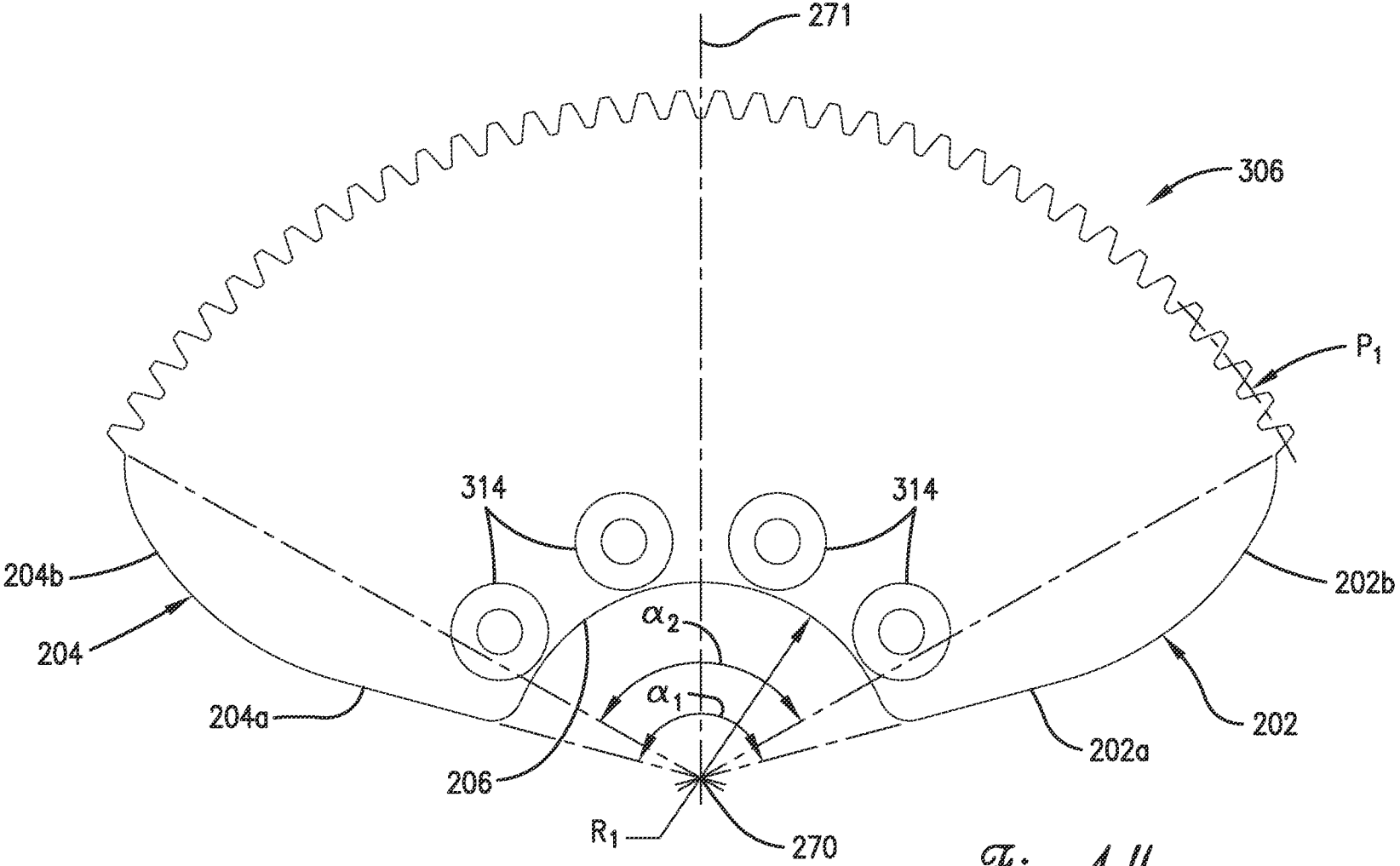
FIG. 14 is a front view of the quick-replacement moon gear of the quick-replacement moon gear assembly shown in FIGS. 9 and 10.

As shown in FIG. 14, in the exemplary embodiment, the quick-replacement moon gear 306 has a semicircular body that extends arcuately at an angle $\alpha_1$ about the central axis 270. The angle $\alpha_1$ is preferably in a range between and including about one hundred and forty-five degrees (145°) and about one hundred and fifty-five degrees (155°), about a central axis 270. More preferable, the angle $\alpha_1$ is about one hundred and fifty degrees (150°). The moon gear 306 is substantially symmetrical about a vertical axis 271. It is noted that in the exemplary embodiment, the central axis 270 is aligned with the rotation axis 252 of the gate arm shaft 112 when assembled thereto (see FIG. 9).

In the exemplary embodiment, the moon gear 306 has a semicircular cutout 206 having an inner radius $R_1$, which is sized to correspond to the inner circumferential surface 330 of the notch 316 (shown in FIG. 11). Two (2) radial walls 202 and 204 extend generally radially outward from the cutout 206 to the outer peripheral edge of the moon gear 306. Each radial wall includes a generally straight first portion 202*a* and 204*a* and an arcuate second portion 202*b* and 204*b*. The arcuate second portions are sized and shaped to limit an amount of rotation of the moon gear 306 when used with the bump stop assemblies 210 and 212, as described herein.

In operation, when the moon gear 306 is coupled to the gear hub 304, the semicircular cutout 206 is placed adjacent the inner circumferential surface 330, such that the two surfaces are in at least substantially face-to-face contact. Furthermore, the first portions 202*a* and 204*a* of the radial walls 202 and 204 are positioned adjacent the pair of radial wall portions 328 of gear hub 304, respectively. Further, each wall first portion 202*a* and 204*b* is in at least substantially face-to-face contact with a respective radial wall portion 328. Referring back to FIGS. 7 and 8, when the gate arm 20 is in the horizontal position, the second portion 204*b* is in contact with the horizontal bump stop assembly 210. When the gate arm 20 is in the vertical position, the second portion 202*b* is in contact with the vertical bump stop assembly 212.

Referring back to FIG. 14, in the exemplary embodiment, the plurality of holes 314 are defined through the moon gear 306, being equi-spaced arcuately about the central axis 270. A pitch diameter Pi defines the outer radial extent of the gear teeth and is selected to intermesh with another gear of the gear train 110, as depicted in FIGS. 3-5, to define a gear ratio between the moon gear 306 and the motor 108. As depicted in FIG. 14, the gear teeth extend arcuately at an angle $\alpha_2$, which is about one hundred and twenty degrees (120°) about a central axis 270.

As described above, the gate arm 20 is generally rotated between a substantially horizontal position to a generally vertical position, providing an angular range of gate arm motion of about ninety degrees (90°). It should be noted however, that the gate arm 20 may rotate more than ninety degrees (90°), for example, during setup and/or calibration procedures or instances of gate failure. The gear ratio between the moon gear 306 and the motor 108 is determined based on actual travel limits of the gate arm 20 and the desire to limit the moon gear 306 from turning more than about one hundred and twenty degrees (120°) between the gate arm travel limits.

Figure 15:
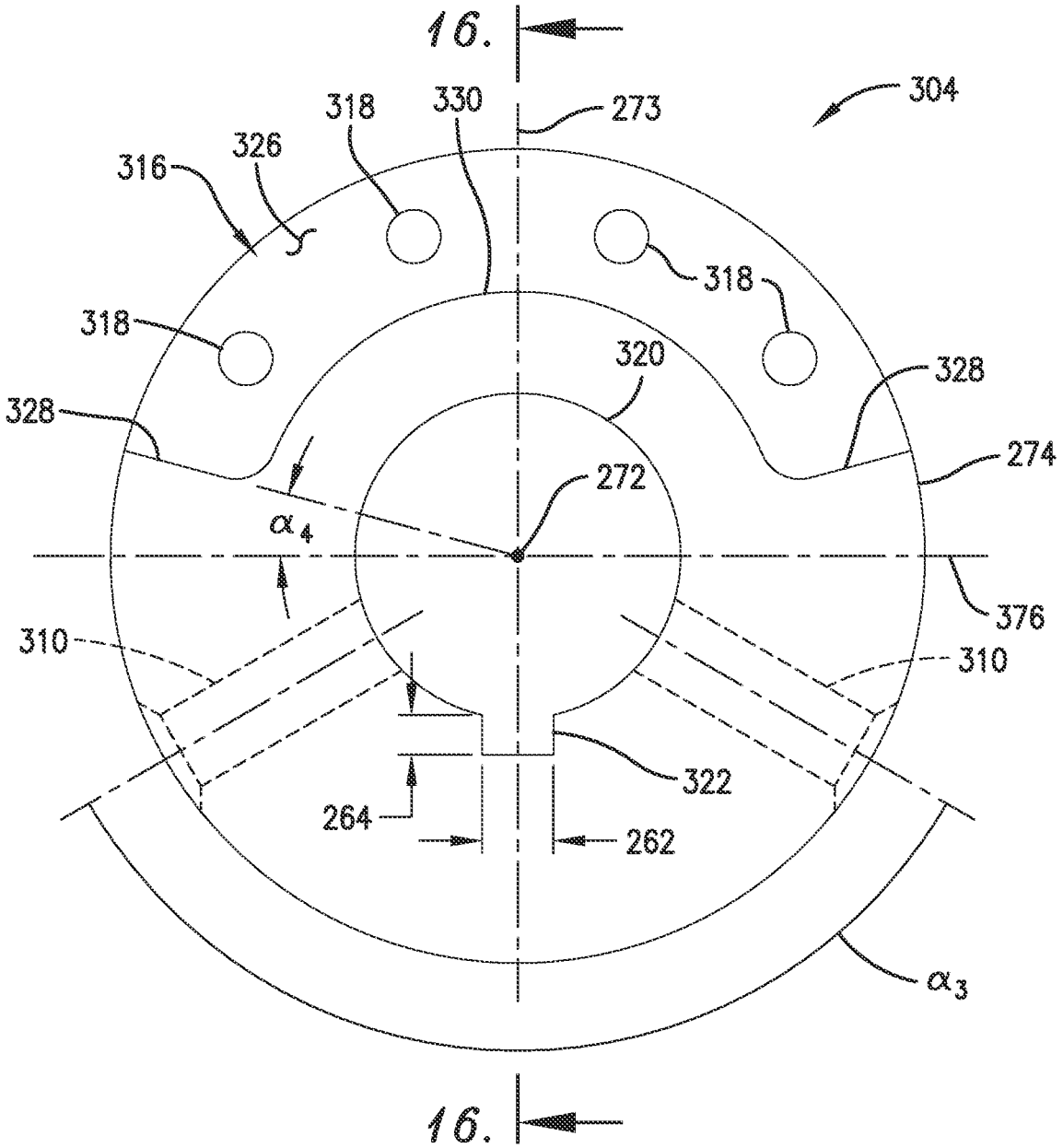
FIG. 15 is a front view of the gear hub of the quick-replacement moon gear assembly shown in FIGS. 9 and 10.
Figure 16:
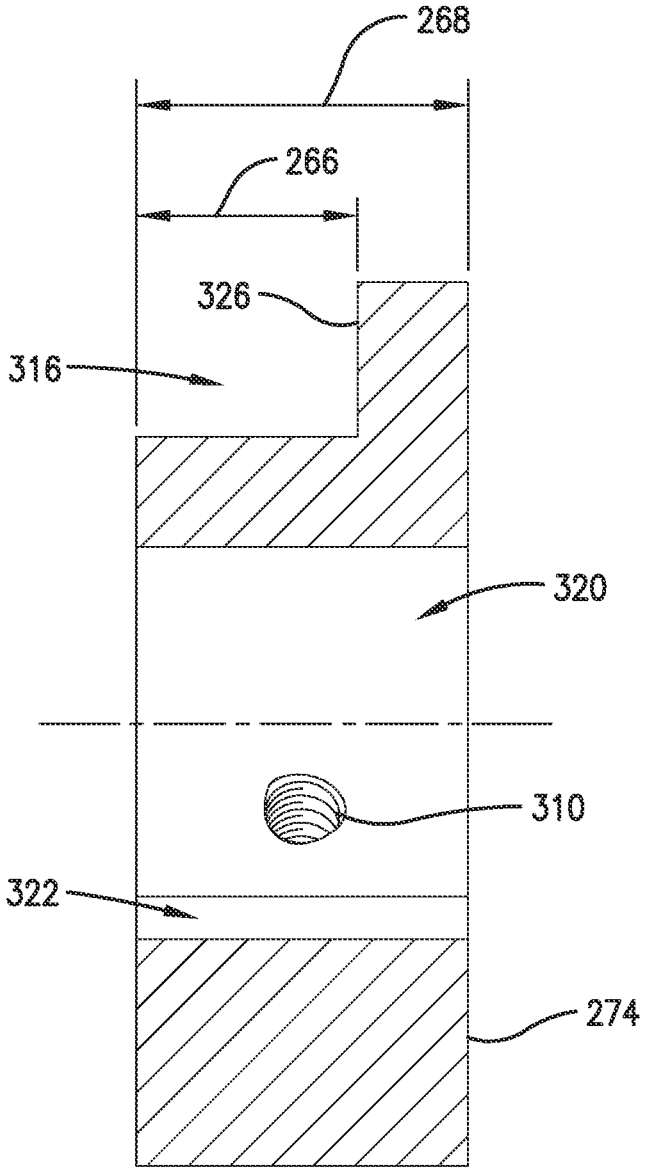
FIG. 16 is a side section view of the gear hub taken along line 16-16 of shown in FIG. 15.

FIG. 15 is a front view of the gear hub 304. FIG. 16 is a side section view of the gear hub 304 taken about line 16-16 of FIG. 15. In the exemplary embodiment, the gear hub 304 includes a substantially circular body portion 274 extending about a central axis 272. As discussed above, the gear hub 304 includes the central opening 320, which is substantially concentric with the central axis 272. The gear hub 304 is substantially symmetrical about a vertical plane 273. As described above, the gear hub 304 includes one or more securing structures 310 for receiving fastener components. As depicted in FIG. 15, the gear hub 304 includes two (2) securing structures 310 arcuately spaced at an angle $\alpha_3$ about the central axis 272. The angle $\alpha_3$ is preferably in a range between and including about one hundred and fifteen degrees (115°) and about one hundred and twenty-five degrees (125°). Most preferably, the angle $\alpha_3$ is about one hundred and twenty degrees (120°). Each securing structure 310 extends substantially radially through the body portion 274. As shown in FIG. 16, the securing structures 310 are substantially centered on the body portion 274.

The arcuate notch 316 is defined in the body portion 274 and, as described above, defines the axial edge portion 326, the pair of radial wall portions 328, and the inner circumferential surface 330. The radial wall portions 328 are oriented at an angle $\alpha_4$, which is about fifteen degrees (15°) from a horizontal axis 276. As such, the pair of radial wall portions 328 are arcuately spaced about one hundred and fifty degrees (150°) from each other, which corresponds to the preferred arcuate angle of the moon gear 306.

In the exemplary embodiment, the plurality of securing structures 318 are defined through the body portion 274, and more particularly, in the axial edge portion 326, of the gear hub 304. The securing structures 318 are equi-spaced arcuately about the central axis 272, positioned to align with the plurality of holes 314 of the moon gear 306. In the example embodiment, the securing structures 318 are threaded holes, although other securing methods are contemplated in other aspects of the present invention.

As shown in FIG. 15, the keyway 322 has a width 262 and a depth 264, which are sized and shaped to receive the shaft key 312. In particular, the width 262 and depth 264 are sized to slidably engage the shaft key 312. Furthermore, the central opening 320 has a diameter that is sized and shapes to provide a slip fit with the gate arm shaft 112. As used herein, the phrase "slip fit" means a value of tightness between the central opening 320 and the outer diameter of $D_1$ of the gate arm shaft 112, i.e., an amount of clearance between the two (2) components. A small amount of positive clearance is referred to as a slip, loose, or sliding fit. A negative amount of clearance is commonly referred to as a press fit, where the magnitude of interference determines whether the fit is a light interference fit or interference fit.

As shown in FIG. 16, the gear hub 304 has a width 268. The notch 316 is formed at a depth 266, which is less than the width 268. In the example embodiment, the depth 266 is about two-thirds (⅔) of the width 268. In certain other aspects of the present invention, the depth 266 may be any desired depth that enables the gear hub 304 to function as described herein.

Both the moon gear 306 and the gear hub 304 may be suitably fabricated from any number of suitable materials, including for example, and without limitation, metal, fiber-reinforced polymers, engineering plastics, or other suitable materials. However, in alternative aspects of the present invention, the moon gear 306 and the gear hub 304 may be constructed of different materials from each other, without departing from the scope of the invention. In some aspects of the present invention, the gear hub 304 may alternatively be integrally formed with the gate arm shaft 112 or secured to the gate arm shaft 112 in manners other than shown.

In operation, when the moon gear 306 requires servicing and or maintenance, an operator may remove the moon gear 306 without removing the gate arm shaft 112, which is traditionally required in prior art automatic grade crossing gate systems. More particularly, the operator may open the enclosure 122, for example, by rotating the rotatable handle 178 (shown in FIG. 6) to disengage the latching member 180 (shown in FIG. 6) from the lock member 182 (shown in FIG. 6). The lid 172 (shown in FIG. 6) may be rotated to an open position relative to the base 170 (shown in FIG. 6) to provide the operator with access to the gear train 110 (shown in FIGS. 3-5).

The operator may remove the plurality of fastener components 308 from the quick-replacement moon gear assembly 302. As discussed above, the fastener components 308 secure the moon gear 306 to the gear hub 304. After each of the fastener components 308 is removed, for example, by unthreading the fastener component 308, the moon gear may be removed from the enclosure 122 for servicing and/or replacement. The gear hub 304 remains fixed to the gate arm shaft 112. It is also particularly noted that the moon gear 306 is displaceable in a generally radial direction relative to the gear hub 304 and the gate arm shaft 112, while the gear hub 304 and the gate arm shaft 112 remain axially in place.

Installing or reinstalling the moon gear 306 is facilitated by the arcuate notch 316. For example, the moon gear is sized and shaped to securely fit into the notch 316 of the gear hub 304. The operator may hold the moon gear 306 in place in the notch 316 and insert each of the fastener components 308. After each of the fastener components 308 is tightened to the gear hub 304, the moon gear to rotatably and axially secured to the gate arm shaft 112 without the need to remove or otherwise adjust the position of the gate arm shaft 112. This facilitates ease of maintenance of the grade crossing gate system 10.

Advantageously, embodiments of the present disclosure provide an easily replaceable gear train, and more particularly, a moon gear of a gear train for a crossing gate mechanism. The moon gear assembly, including the gear hub and removeable moon gear, enables a user to rapidly service or replace a broken moon gear at the gate mechanism. The moon gear assembly enables the gate mechanism to maintain calibration by not requiring the gate arm shaft to be removed or otherwise moved (e.g., axially shifted) during maintenance (including replacement) of the moon gear. As such, a position of a gate arm of the crossing gate mechanism is maintained or known by the crossing gate logic. Moreover, in certain crossing gates mechanisms, the typical cam lobe assembly that requires course field adjustments does not need to be adjusted. This facilitates reducing the time for troubleshooting and maintaining the crossing gate mechanism, as well as increasing the accuracy and safety of the crossing gate mechanism.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

Those of ordinary skill in the art will appreciate that any suitable combination of the previously described embodiments may be made without departing from the spirit of the present invention.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

What is claimed is:

1. A crossing gate mechanism comprising:

a gate mechanism enclosure defining an interior space;

an axially extending gate arm shaft extending into the gate mechanism enclosure and being rotatable relative thereto; and a quick-replacement moon gear assembly coupled to the gate arm shaft for rotation therewith and being positioned within the interior space, said quick-replacement moon gear assembly comprising a gear hub fixed to the gate arm shaft for rotational movement therewith, and a quick-replacement moon gear releasably coupled to the gear hub, said quick-replacement moon gear being removeable from the interior space while the gear hub remains fixed to the gate arm shaft, said gear hub including a circular body portion defining a central opening receiving the gate arm shaft therethrough, said quick-replacement moon gear presenting a circular pitch that is substantially concentric with the central opening of the gear hub, said gear hub including an axial notch defined in the body portion, with the axial notch receiving at least a portion of the quick-replacement moon gear, said axial notch being arcuate in shape and defining an axial edge portion, a pair of radial wall portions, and an inner circumferential surface.

2. The crossing gate mechanism in accordance with claim 1, said quick-replacement moon gear and said gear hub being configured and intercoupled such that the quick-replacement moon gear is removable from the interior space without requiring axial shifting of the gate arm shaft.

3. The crossing gate mechanism in accordance with claim 2, further comprising a gate arm position sensing assembly operably coupled to the gate arm shaft.

4. The crossing gate mechanism in accordance with claim 3, further comprising a motor drivingly coupled to the gate arm shaft via the quick-replacement moon gear assembly.

5. The crossing gate mechanism in accordance with claim 1, said quick-replacement moon gear including a semicircular body defining a semicircular cutout corresponding in size to the inner circumferential surface of the axial notch, said cutout being positioned adjacent the inner circumferential surface such that the cutout and the inner circumferential surface are substantially in face-to-face contact.

6. The crossing gate mechanism in accordance with claim 1, said semicircular body extending arcuately at an angle in a range between and including about one hundred and forty-five degrees (145°) and about one hundred and fifty-five degrees (155°).

7. The crossing gate mechanism in accordance with claim 1, said quick-replacement moon gear including a semicircular body defining a first radial wall and a symmetrical second radial wall, each of which extend generally radially outward from a central axis of the semicircular body, each of said first and second radial walls including a straight first portion and an arcuate second portion, each of said straight first portions being positioned adjacent to and in substantially face-to-face contact with a respective one of the radial wall portions.

8. The crossing gate mechanism in accordance with claim 7, said first radial wall being arcuately spaced from the second radial wall relative to the central axis of the semicircular body at an angle in a range between and including about one hundred and forty-five degrees (145°) and about one hundred and fifty-five degrees (155°).

9. A crossing gate mechanism comprising:

a gate mechanism enclosure defining an interior space;

an axially extending gate arm shaft extending into the gate mechanism enclosure and being rotatable relative thereto; and a quick-replacement moon gear assembly coupled to the gate arm shaft for rotation therewith and being positioned within the interior space, said quick-replacement moon gear assembly comprising a gear hub fixed to the gate arm shaft for rotational movement therewith, and a quick-replacement moon gear releasably coupled to the gear hub, said quick-replacement moon gear being removeable from the interior space while the gear hub remains fixed to the gate arm shaft, said gear hub including one or more axially extending securing structures, each receiving a respective fastener component to secure the quick-replacement moon gear to the gear hub, said quick-replacement moon gear including one or more axially extending holes defined therein, each hole of said one or more axially extending holes being axially aligned with a respective one of the securing structures, with the respective fastener component being also received in said each hole, said gear hub including an axial notch, with the axial notch receiving at least a portion of the quick-replacement moon gear, said axial notch being arcuate in shape and defining an axial edge portion, a pair of radial wall portions, and an inner circumferential surface, said quick-replacement moon gear including a semicircular body defining a semicircular cutout corresponding in size to the inner circumferential surface of the axial notch, said cutout being positioned adjacent the inner circumferential surface such that the cutout and the inner circumferential surface are substantially in face-to-face contact, each axially extending securing structure extending axially into the axial edge portion, each axially extending hole extending axially through the semicircular body.

10. The crossing gate mechanism in accordance with claim 9, said quick-replacement moon gear and said gear hub being configured such that the quick-replacement moon gear is removable from the interior space without requiring axial shifting of the gate arm shaft.

11. A crossing gate mechanism comprising:

a gate mechanism enclosure defining an interior space;

an axially extending gate arm shaft extending into the gate mechanism enclosure and being rotatable relative thereto;

a quick-replacement moon gear assembly coupled to the gate arm shaft for rotation therewith and being positioned within the interior space, said quick-replacement moon gear assembly comprising a gear hub fixed to the gate arm shaft for rotational movement therewith, and a quick-replacement moon gear releasably coupled to the gear hub, said quick-replacement moon gear being removeable from the interior space while the gear hub remains fixed to the gate arm shaft; and a shaft key, said gate arm shaft defining first and second axially opposite ends, said gate arm shaft including an axially extending groove spaced from at least one of the ends, said gear hub including a circular body portion defining a central opening receiving the gate arm shaft therethrough, said gear hub further including a keyway defined in the body portion along the central opening, said axial groove and the keyway receiving the shaft key therein to rotatably secure the gear hub to the gate arm shaft.

12. The crossing gate mechanism in accordance with claim 11, said gear hub including one or more radially extending securing structures extending through the circular body portion from a periphery of the gear hub to the central opening, each of said securing structures receiving a respective fastener component to secure the gear hub to the gate arm shaft.

13. The crossing gate mechanism in accordance with claim 12, said one or more radially extending securing structures comprising two securing structures spaced arcuately at an angle in a range between and including about one hundred and fifteen degrees (115°) and about one hundred and twenty-five degrees (125°).

14. The crossing gate mechanism in accordance with claim 11, said quick-replacement moon gear and said gear hub being configured and intercoupled such that the quick-replacement moon gear is removable from the interior space without requiring axial shifting of the gate arm shaft.

15. The crossing gate mechanism in accordance with claim 14, further comprising a gate arm position sensing assembly operably coupled to the gate arm shaft.

16. The crossing gate mechanism in accordance with claim 15, further comprising a motor drivingly coupled to the gate arm shaft via the quick-replacement moon gear assembly.

17. A crossing gate mechanism comprising:

a gate mechanism enclosure defining an interior space;

an axially extending gate arm shaft extending into the gate mechanism enclosure and being rotatable relative thereto; and a quick-replacement moon gear assembly coupled to the gate arm shaft for rotation therewith and being positioned within the interior space, said quick-replacement moon gear assembly comprising a gear hub fixed to the gate arm shaft for rotational movement therewith, and a quick-replacement moon gear releasably coupled to the gear hub, said quick-replacement moon gear being removeable from the interior space while the gear hub remains fixed to the gate arm shaft, said gate mechanism enclosure comprising a horizontal bump stop assembly and a vertical bump stop assembly, said rotatable gate arm shaft being rotatable between a first position and a second position, said quick-replacement moon gear including a semicircular body defining first and second radial walls, each of which extends generally radially outward from a central axis of the semicircular body, said first radial wall contacting the horizontal bump stop assembly when the rotatable gate arm shaft is in the first position, said second radial wall contacting the vertical bump stop assembly when the rotatable gate arm shaft is in the second position.

18. The crossing gate mechanism in accordance with claim 17, each of said first and second radial walls including a straight first portion and an arcuate second portion, said arcuate second portion of the first radial wall being substantially in face-to-face contact with the horizontal bump stop assembly when the rotatable gate arm shaft is in the first position, and said arcuate second portion of the second radial wall being substantially in face-to-face contact with the vertical bump stop assembly when the rotatable gate arm shaft is in the second position.

19. The crossing gate mechanism in accordance with claim 17, said quick-replacement moon gear and said gear hub being configured and intercoupled such that the quick-replacement moon gear is removable from the interior space without requiring axial shifting of the gate arm shaft.

20. A crossing gate mechanism comprising:

a gate mechanism enclosure defining an interior space;

an axially extending gate arm shaft extending into the gate mechanism enclosure and being rotatable relative thereto; and a quick-replacement moon gear assembly coupled to the gate arm shaft for rotation therewith and being positioned within the interior space, said quick-replacement moon gear assembly comprising a gear hub fixed to the gate arm shaft for rotational movement therewith, and a quick-replacement moon gear releasably coupled to the gear hub, said quick-replacement moon gear being removeable from the interior space while the gear hub remains fixed to the gate arm shaft, said gate mechanism enclosure comprising a base and a lid together at least in part defining the interior space, said lid being movably positionable relative to the base, such that the gate mechanism enclosure is shiftable between a closed configuration, in which the quick-replacement moon gear is substantially enclosed, and an opened configuration, in which the quick-replacement moon gear is accessible to a user, said gear hub including a circular body portion and an axially extending securing structure defined therein, said quick-replacement moon gear including a semicircular body and an axially extending hole defined therein, said quick-replacement moon gear and said gear hub being intercoupled such that the axially extending hole is axially aligned with the axially extending securing structure, with the aligned axially extending hole and the securing structure receiving a fastener component to secure the quick-replacement moon gear to the gear hub.

* * * * *